United States Patent [19]

Kang

[11] Patent Number: 5,033,141

[45] Date of Patent: Jul. 23, 1991

[54] COMBINED KEY CHAIN, PICTURE FRAME AND TAB-TOP OPENER

[76] Inventor: Tae S. Kang, 272 Village Circle Dr., Fort Lee, N.J. 07024

[21] Appl. No.: 612,623

[22] Filed: Nov. 13, 1990

[51] Int. Cl.[5] ..... B25F 1/00

[52] U.S. Cl. ..... 7/151; 81/3.09; 81/3.55; 70/456 R

[58] Field of Search ..... 81/3.07, 3.09, 3.55, 81/3.4; D3/62, 64; D8/33, 34, 40; 7/151; 70/456 R

[56] References Cited

U.S. PATENT DOCUMENTS

D. 226,555 10/1982 McNally ..... D 3/62
D. 278,950 5/1985 Vaughan ..... D 8/18
D. 300,582 4/1989 Hodge ..... D 3/62
3,583,317 6/1971 Gibson ..... D 3/62
4,741,434 5/1988 Liebman ..... 70/456 R

*Primary Examiner*—Roscoe V. Parker
*Attorney, Agent, or Firm*—Klauber & Jackson

[57] ABSTRACT

A combination picture frame and tap-top opener, includes a substantially U-shaped frame having opposite, spaced apart and parallel legs, each leg having an inner edge with a guideway and a free end with a projection thereat, the free ends of the legs defining an opening therebetween; two panels for holding at least one picture therebetween, the panels being removably mounted within the guideways of the frame; a removable retainer for retaining the panels in the frame, the retainer including a track for receiving the projections so as to removably connect the retainer with the frame; and a tap-top opener formed on the removable retainer.

17 Claims, 3 Drawing Sheets

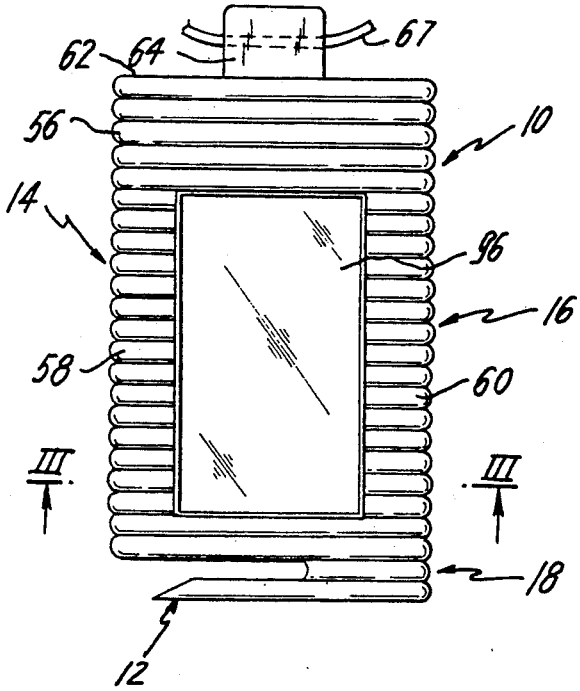
FIG. 1
FIG. 2
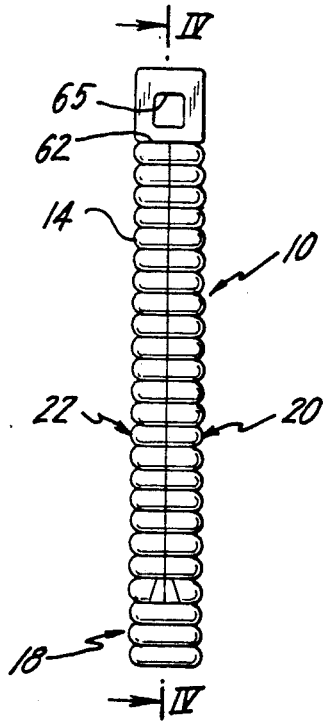
FIG. 4
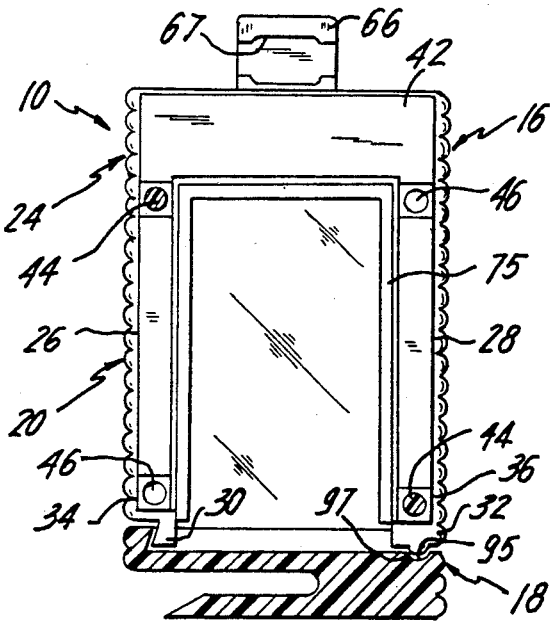
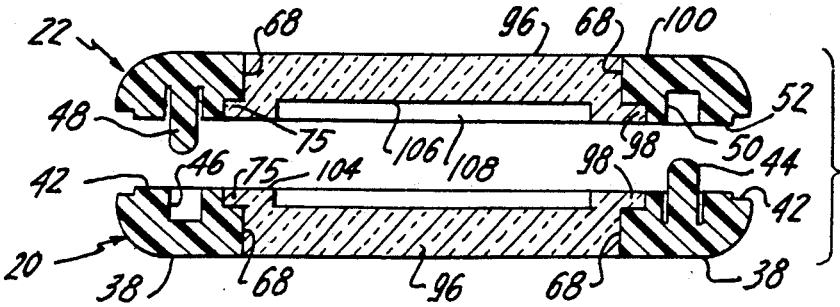
FIG. 3

FIG. 6
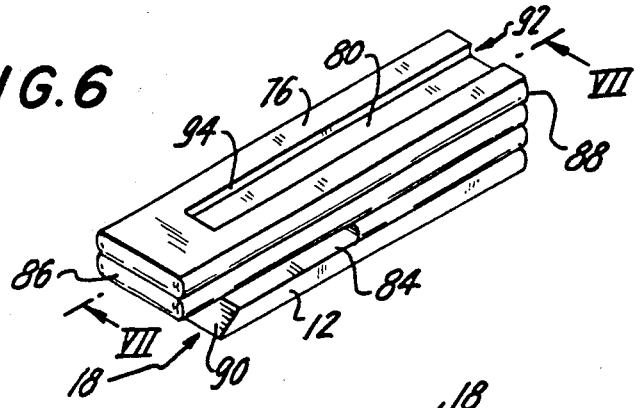
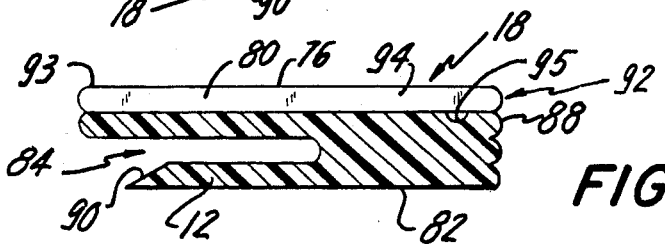
FIG. 7
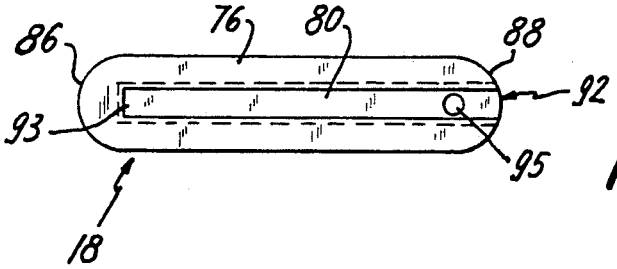
FIG. 8
FIG. 9
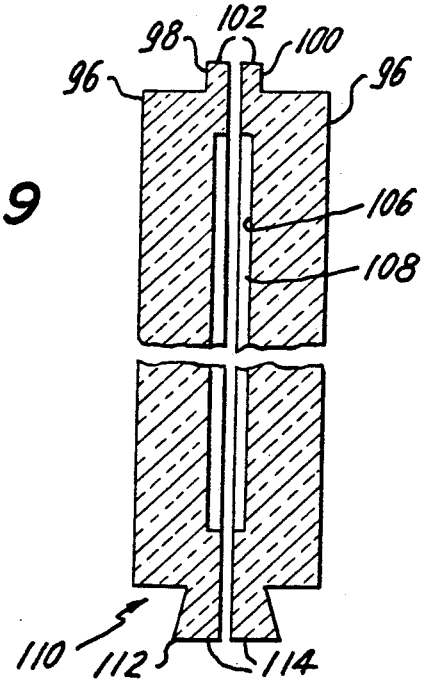

COMBINED KEY CHAIN, PICTURE FRAME AND TAB-TOP OPENER

BACKGROUND OF THE INVENTION

The present invention relates generally to a miniature picture frame, and more particularly, to the combination of a miniature picture frame with a tab-top opener and a key chain.

People enjoy carrying photographs of their loved ones on their person as they go about their daily business. However, photographs are relatively fragile and require protection if they are to be carried from day to day.

It is well known that people commonly carry photographs in their wallets or purses in soft, transparent sleeves. However, this method of carrying and protecting photographs is less than satisfactory in many instances. For example, the photographs are often damaged by dirt between the photograph and the protective sleeve. Additionally, full size photographs (for example, 3"×5") are often bent and damaged at their corners when carried in wallets.

It has been recognized that miniaturized pictures may be protected for daily transportation by encasing them in a rigid, transparent plastic case. See, for example, U.S. Design Pat. No. 266,555 to McNally and U.S. Design Pat. No. 293,287 to Cauque et al. However, this method suffers from the disadvantage that the miniaturized picture is sealed between rigid, plastic covers, and is not interchangeable with other pictures.

It has also been well known for many years that beverage cans and the like employ a tab-top for opening the same. Specifically, a central portion of the can top is defined by a weakened or scored boundary. To create an access opening therein, a tab-top is provided as a lever. When one end of the lever is pulled upwardly by the user, the opposite end is pivoted downwardly against the weakened or scored portion. Accordingly, there is a rupture thereat which bends or hinges the weakened or scored portion downwardly into the can so as to create an opening.

It has become evident that there exist certain complications in opening beverage cans having a tab-top. One common problem is the ease with which a fingernail can be damaged in attempting to pry up one end of the lever. Additionally, those persons who do not have long fingernails are unable to lift the end of the lever up from against the can top without using an object such as a key or the like.

Although various tab-top openers are known, such openers are generally bulky and are cumbersome for a person to carry at all times. See, for example, U.S. Pat. Nos. 4,524,646 to Kimberlin, Jr.; 4,660,446 to Soltis; 4,745,829 to VanHoutte et al; and 4,864,898 to Tricinella; and U.S. Design Pat. Nos. D269,587 to Hanslmair; and D274,688 to Escalante.

Furthermore, tab-type openers have been combined with other devices. For example, U.S. Design Pat. No. D249,984 to Parker discloses a tab can opener which is adapted to be a key chain fob. However, these tab-top openers are bulky and are not items which can easily be carried by a person during his daily routine. See also U.S. Pat. Nos. 4,373,223 to Miller; 4,825,728 to Mitchell; 4,829,618 to McKee; 4,854,856 to Steiger, Jr. et al; and German Pat. No. 3,240,377.

For a combined key ring and frame support, see U.S. Design Pat. No. D300,582 to Hodge.

OBJECTS AND SUMMARY OF THE INVENTION

Accordingly, it is an object of the present invention to provide a combination key chain-picture frame that allows the owner to change the picture that is held within the frame.

It is another object of the present invention to provide a key chain-picture frame that has incorporated therein a tab-top opener.

It is still another object of the present invention to provide a tab-top opener with a key chain-picture frame wherein the tab-top opener does not increase the bulk of the key chain-picture frame.

In accordance with an aspect of the present invention, a combination picture frame and tab-top opener, includes panel means for holding at least one picture; frame means for removably holding the panel means such that at least one picture is visible; removable retaining means for retaining the panel means in the frame means, the retaining means being removably connected with the frame means; and a tab-top opener formed on one of the frame means and the removable retaining means.

In accordance with another aspect of the present invention, a combination picture frame and tab-top opener, includes a substantially U-shaped frame having opposite, spaced apart and parallel legs, each leg having an inner edge with a guideway and a free end with a projection thereat, the free ends of said legs defining an opening therebetween; panel means for holding at least one picture, said panel means being removably mounted within said guideways of said frame means; removable retaining means for retaining said panel means in said frame, said retaining means including a track for receiving said projections so as to removably connect said retaining means with said frame; and a tab-top opener formed on one of said frame and said removable retaining means.

The above and other objects, features and advantages of the present invention will become readily apparent from the following detailed description which is to be read in connection with the accompanying drawings.

BRIEF DESCRIPTION OF THE DRAWINGS

For a more complete understanding of the present invention, reference may be had to the following detailed description considered in conjunction with the accompanying drawings, in which:

FIG. 1 is a front elevational view of a combination key chain, picture frame and tab-top opener according to a first embodiment of the present invention;

FIG. 2 is a side elevational view of the combination key chain, picture frame and tab-top opener illustrated in FIG. 1;

FIG. 3 is an exploded, cross-sectional view of the combination key chain, picture frame and tab-top opener illustrated in FIG. 1, taken along line III—III thereof;

FIG. 4 is a cross-sectional view of the combination key chain, picture frame and tab-top opener of FIG. 2, taken along line IV—IV thereof;

FIG. 6 is a perspective view of a removable portion of the frame of the combination key chain, picture frame and a tab-top opener of FIG. 1;

FIG. 7 is a cross-sectional view of the removable portion illustrated in FIG. 6, taken along line VII—VII thereof;

FIG. 8 is a top plan view of the removable portion of FIG. 6, the dashed lines representing the degree of recession at the bottom of the slanted inner track; and FIG. 9 is a vertical cross-sectional view of two transparent panels which are inserted into the combination key chain, picture frame and tab-top opener according to the present invention.

DETAILED DESCRIPTION OF THE PREFERRED EMBODIMENTS

Figure 5:
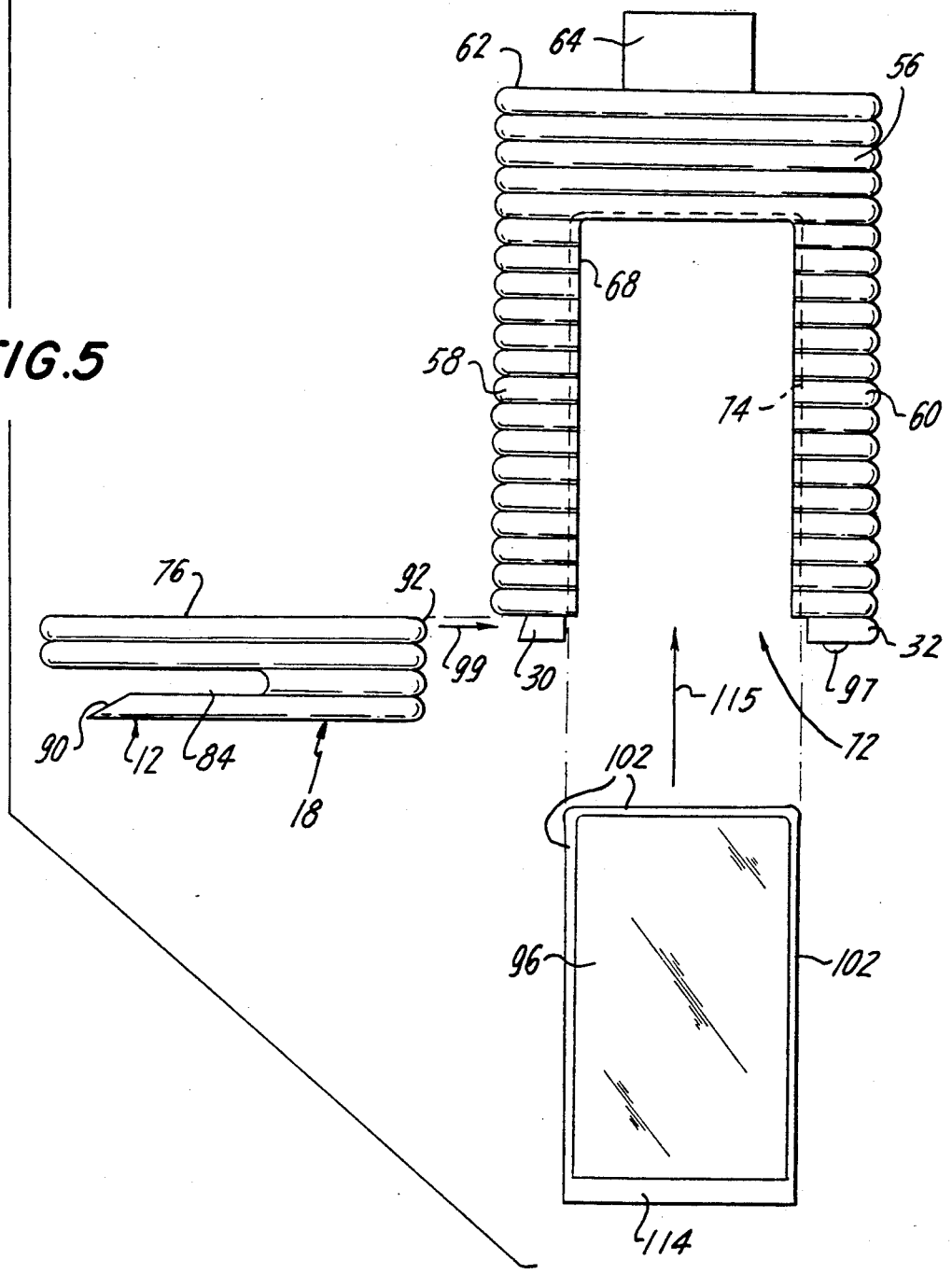
FIG. 5 is an exploded front elevational view of the combination key chain, picture frame and tab-top opener of FIG. 1, showing the direction of insertion of the pieces for assembly.

Referring in detail to the drawings, and initially to FIGS. 1-5, a combination key chain-picture frame 10 having a tab-top opener 12 incorporated therein has dimensions suitable for being carried daily and provides means for interchanging photographs which are protected therein. Furthermore, tab-top opener 12 is provided with no increase in the bulk of combination key chain-picture frame 10.

As shown, combination key chain-picture frame 10 has an outer frame 14 of a substantially rectangular shape. Outer frame 14 includes a substantially U-shaped primary frame 16 and a substantially U-shaped removable member 18 which engages primary frame 16. Specifically, primary frame 16 comprises two frame halves 20 and 22 that are essentially mirror-images of one another with some distinctions to be described below. As such, the following description of frame half 20 should be understood as including frame half 22 unless otherwise indicated.

Substantially U-shaped frame half 20 includes a frame upper portion 24 and side leg portions 26 and 28, with side leg portions 26 and 28 having wedge-shaped projections 30 and 32, respectively, extending from ends 34 and 36 thereof for a purpose to be described hereinbelow. Primary frame half 20 includes an outer side 38 and an opposite inner side 42. Inner side 42 has a combination of male pins 44 extending therefrom and female anchor holes 46 molded therein. Primary frame half 22 is similarly provided with male pins 48 and female anchor holes 50 positioned on inner side 52 of frame half 22 to mate with corresponding female anchor holes 46 and male pins 44 provided on inner side 42 of frame half 20.

In assembling primary frame 16, primary frame halves 20 and 22 are positioned such that inner side 42 is directly opposite inner side 52, and male pins 44 and 48 are positioned opposite corresponding female anchor holes 46 and 50. The primary frame halves 20 and 22 are pressed together, seating male pins 44 and 48 in female anchor holes 46 and 50, and locking frame halves 20 and 22 together.

Primary frame 16 thus has an upper portion 56 provided by united frame upper portions 24, and side leg members 58 and 60 which are provided by the union of side leg portions 26 and side portions 28, respectively. Upper portion 56 has an upper edge 62 from which there extends a boss 64 having a through hole 65 for receiving a key chain 67. Loop 64 is similarly formed by the union of two half loops 66 provided on each of primary frame halves 20 and 22, each half loop 66 having a recess 67 so that recesses 67 together form through hole 65. Upper portion 56 and side members 58 and 60 together define an inner edge 68 which further defines a rectangular space 70 that is open at an end 72 opposite upper portion 56. Inner edge 68 includes a slot 74 which runs the entire length of inner edge 68, slot 74 being defined by corresponding recesses or guideways 75 formed in frame halves 20 and 22.

Referring now to FIGS. 6-9, removable member 18 has an upper edge 76 such that inner edge 68 and upper edge 76 form a substantially continuous rectangular outline when primary frame 16 and removable member 18 are fully engaged, as described below. In this manner, upper edge 76 is provided with a wedge-shaped track 80 therealong which is continuous with slot 74 when removable member 18 is engaged with primary frame 16.

Removable member 18 is provided near a side 82 opposite track 80, with a transverse recess 84 extending from one end 86 of removable member 18 partially toward the other end 88 thereof. Transverse recess 84 thereby defines tab-top opener 12 as a lever which extends parallel to the longitudinal axis of removable member 18. The free end of tab-top opener 12 is beveled, as at 90, to permit ease of insertion thereof under a pop top of a can.

Track 80 of removable member 18 has an open end 92, into which projections 30 and 32 are inserted, and a closed end 93. Because of the wedge-shaped nature of track 80, inner walls 94 thereof slope inwardly towards their top. Since projections 30 and 32 are provided with a complementary shape, that is, projections 30 and 32 are narrower near their top, removable member 18 is retained on primary frame 16. A depression 95 is formed in track 80 near open end 92. Depression 95 functions to stabilize removable member 18, together with primary frame 16, by receiving a corresponding bead 97 formed on projection 32, which is seated in depression 95 when primary frame 16 is fully inserted into track 80, as shown best in FIG. 4.

Two rectangular, clear plastic panels 96 are provided, having a thickness approximately equal to that of outer frame 14 when they are laid back to back. Panels 96, as best shown in FIG. 9, have outer edges 98 which are rabbeted so that, when plastic panels 96 are laid back to back, the rabbeted surfaces 100 face out, forming a tongue 102 which is received into slot 74 of primary frame 16. The inner side 104 of each plastic panel 96 has a slightly depressed surface 106 so that a cavity 108 is formed for receiving a photograph when plastic panels 96 are placed back to back. Plastic panels 96 are each further provided at a lower edge 110 with a tongue 112. Tongues 112 form an insert 114 when plastic panels 96 are laid back to back, insert 114 being complimentary in shape to track 80.

Combination key chain-picture frame 10 is assembled by laying plastic panels 96 back to back and fully inserting them into slot 74, in the direction of arrow 115 in FIG. 5. This results in the insert 114 coming into approximately continuous alignment with projections 30 and 32. Removable member 18 is subsequently, positioned so that open end 92 of track 80 is adjacent to projection 30. Removable member 18 is pushed laterally in the direction of arrow 99 (FIG. 5) so that projections 30 and 32 and insert 114 are slidingly received into track 80 until projection 30 contacts closed end 93 of track 80.

In operation, tab lever 90 is inserted under a tab-top (not shown) of a beverage container (not shown). In this case, side 82 of removable member 18 rests on the edge of the beverage container. The end of the tab-top can then be levered upwardly in one of two ways. Firstly, upper portion 56 of combination key chain-picture frame 10 and tab-top opener 12 can be pushed inwardly towards the center of the can top by the user. Alternatively, upper portion 56 of outer frame 14 can be pulled outwardly so that side 82 of removable member 18 is levered against the edge of the can, thereby moving tab lever 12, and the tab-top engaged therewith, upwardly.

Having described specific preferred embodiments of the invention, it will be appreciated that the present invention is not limited to those precise embodiments. For example, it should be clear that the shape of outer frame 14 may be other than rectangular, for instance, the outer frame may be triangular, wherein a side is adapted to be removable in the same manner as the preferred embodiment disclosed herein. Additionally, it should be appreciated that the present invention contemplates the use of only one transparent panel as well as two transparent panels as herein disclosed. For example, the primary frame can have an opaque panel either formed integrally therewith or inserted therein in the manner described above. Alternatively, a single opaque panel can be used with different pictures adhered thereto.

As another alternative, tab-top opener 12 can be formed on upper portion 56, and loop 64 formed on removable portion 18.

Therefore, various changes and modifications can be effected therein by one of ordinary skill in the art without departing from the spirit or scope of the invention as defined by the appended claims.

What is claimed is:

1. A combination picture frame and tab-top opener, comprising:

panel means for holding at least one picture;

frame means for removably holding said panel means such that at least one picture is visible;

removable retaining means for retaining said panel means in said frame means, said retaining means being removably connected with said frame means; and a tab-top opener formed on one of said frame means and said removable retaining means.

2. A combination picture frame and tab-top opener according to claim 1, wherein said frame means has a substantially U-shaped configuration with opposite legs and said panel means has a substantially rectangular configuration which fits between the legs of said substantially U-shaped frame means.

3. A combination picture frame and tab-top opener according to claim 2, wherein said substantially U-shaped frame means has an open end at free ends of said legs thereof for receiving said panel means, and said retaining means is removably secured to the, free ends of said legs of said frame means in covering relation to said open end.

4. A combination picture frame and tab-top opener according to claim 1, wherein said frame means has an open end for receiving said panel means therein, and said retaining means is removably secured to said frame means in covering relation to said open end.

5. A combination picture frame and tab-top opener according to claim 4, wherein said frame means includes at least one projection adjacent the open end thereof and said retaining means includes a track for receiving said at least one projection so as to removably connect said retaining means with said frame means.

6. A combination picture frame and tab-top opener according to claim 5, wherein at least one said projection has a wedge-shape and said track has a corresponding wedge-shape.

7. A combination picture frame and tab-top opener according to claim 6, wherein said panel means includes insert means having a corresponding wedge-shape for fitting within said track.

8. A combination picture frame and tab-top opener according to claim 5, wherein said frame means includes opposite legs having free ends defining said open end thereof, each said leg including one said projection at the free end thereof, and said track of said retaining means receives said projections at the free ends of said legs to removably connect said retaining means with said frame means.

9. A combination picture frame and tab-top opener according to claim 8, wherein each said leg has an inner edge having guideway means therein for slidably receiving said panel means therein.

10. A combination picture frame and tab-top opener according to claim 9, wherein said panel means includes outer edges which slidably fit within said guideways.

11. A combination picture frame and tab-top opener according to claim 1, wherein said frame means includes a first frame half and a second frame half secured to said first frame half.

12. A combination picture frame and tab-top opener according to claim 1, wherein said panel means includes at least one transparent panel.

13. A combination picture frame and tab-top opener according to claim 12, wherein said panel means includes two transparent panels defining a cavity therebetween for holding a picture.

14. A combination picture frame and tab-top opener according to claim 1, wherein one of said frame means and said removable retaining means is cut-away to define an outer lever which forms said tab-top opener.

15. A combination picture frame and tab-top opener according to claim 14, wherein said tab-top opener is formed on said retaining means.

16. A combination picture frame and tab-top opener according to claim 1, wherein one of said frame means and said retaining means includes loop means for retaining a key chain therein.

17. A combination picture frame and tab-top opener, comprising:

a substantially U-shaped frame having opposite, spaced apart and parallel legs, each leg having an inner edge with a guideway and a free end with a projection thereat, the free ends of said legs defining an opening therebetween;

panel means for holding at least one picture, said panel means being removably mounted within said guideways of said frame means;

removable retaining means for retaining said panel means in said frame, said retaining means including a track for receiving said projections so as to removably connect said retaining means with said frame; and a tab-top opener formed on one of said frame and said removable retaining means.

* * * * *